US006585268B2

(12) United States Patent
Williams

(10) Patent No.: US 6,585,268 B2
(45) Date of Patent: Jul. 1, 2003

(54) CARD AND MARBLE GAME

(76) Inventor: Steven G. Williams, 15, Loraine Ave, Trenton, ON (CA), K8V 6L9

( * ) Notice: Subject to any disclaimer, the term of this patent is extended or adjusted under 35 U.S.C. 154(b) by 0 days.

(21) Appl. No.: 09/877,119

(22) Filed: Jun. 11, 2001

(65) Prior Publication Data

US 2002/0185817 A1 Dec. 12, 2002

(51) Int. Cl.[7] ..... A63F 1/00
(52) U.S. Cl. ..... 273/292; 273/293; 273/290
(58) Field of Search ..... 273/292, 293, 273/241, 276, 153 P, 290; 446/85, 115, 117, 108, 116, 124

(56) References Cited

U.S. PATENT DOCUMENTS 1,124,631 A * 1/1915 Litchfield ..... 446/85
1,541,556 A * 6/1925 Fisher ..... 446/85
2,131,349 A * 9/1938 Kreider ..... 46/24
2,506,184 A * 5/1950 Twining ..... 273/141 R
2,880,001 A * 3/1959 Rosenzweig ..... 273/241
3,042,400 A * 7/1962 O'Rear ..... 273/1
3,066,436 A * 12/1962 Schuh ..... 46/30
3,083,020 A * 3/1963 Terschak ..... 273/126 R
3,610,618 A * 10/1971 Wiggins ..... 108/11
3,643,957 A * 2/1972 Bryant ..... 273/249
3,649,018 A * 3/1972 Beam ..... 273/276
3,690,656 A * 9/1972 Hughes et al. ..... 273/276
3,692,310 A * 9/1972 Martin ..... 273/241
3,695,614 A * 10/1972 Brisson ..... 273/241
D230,870 S * 3/1974 Keim ..... D21/1
3,806,125 A * 4/1974 Bialek ..... 273/241
3,809,407 A * 5/1974 Quigley ..... 273/241
3,822,569 A * 7/1974 Lautrup-Larsen ..... 446/85
3,827,695 A * 8/1974 Hess ..... 206/315.1
D233,053 S * 10/1974 Kolwicz ..... D21/1
3,930,651 A * 1/1976 Rader ..... 273/156
3,990,698 A * 11/1976 Barlow ..... 273/148 R
4,030,762 A * 6/1977 Gilmore ..... 273/248
4,119,320 A * 10/1978 Chorba et al. ..... 273/241
4,146,228 A * 3/1979 Laciste ..... 273/126 R
4,671,515 A * 6/1987 Burgess ..... 273/150
4,938,472 A * 7/1990 Gould et al. ..... 273/157 R
4,955,617 A * 9/1990 Mason et al. ..... 273/256
5,000,717 A * 3/1991 Pfeiffer ..... 248/174
5,004,245 A * 4/1991 Schumacher et al. ..... 273/241
5,007,651 A * 4/1991 Mason et al. ..... 273/256
5,120,068 A * 6/1992 Tablan ..... 273/155
5,236,193 A * 8/1993 Ierulli ..... 273/250
5,301,953 A * 4/1994 Levin ..... 273/157 R
5,403,014 A * 4/1995 Anema et al. ..... 273/148 A
5,520,395 A * 5/1996 Mondello, Jr. ..... 273/276
5,679,002 A * 10/1997 Scelzo ..... 273/241
5,683,087 A * 11/1997 Henshaw et al. ..... 273/237
5,890,741 A * 4/1999 Hollander ..... 281/2
5,897,417 A * 4/1999 Grey ..... 403/340
5,924,907 A * 7/1999 Tobin ..... 446/118
5,954,331 A * 9/1999 Hepburn ..... 273/161
6,062,566 A * 5/2000 Lemons ..... 273/292
6,116,601 A * 9/2000 Kornafel, Jr. ..... 273/249
6,120,027 A * 9/2000 Frankel et al. ..... 273/236
6,213,191 B1 * 4/2001 Nitzsche ..... 108/50.11
6,334,631 B1 * 1/2002 Hollander ..... 281/2
6,340,323 B1 * 1/2002 Glynn ..... 40/406

* cited by examiner

*Primary Examiner*—Benjamin H. Layno
*Assistant Examiner*—Dolores R. Collins
(74) *Attorney, Agent, or Firm*—Dowell & Dowell, P.C.

(57) ABSTRACT

A kit for playing a construction/deconstruction game is described, and includes a plurality of flat planar cards and a plurality of v-shaped articulated cards from which a deconstructable structure can be erected. A plurality of spherical objects, such as marbles, adapted to be fired against the structure, is also provided. A ball retaining wall, adapted to at least partially encircle the structure may also be provided.

4 Claims, 4 Drawing Sheets

CARD AND MARBLE GAME

FIELD OF INVENTION

This invention relates to a kit for playing a game or pastime, and more particularly to a game kit requiring cards from which three dimensional structures can be constructed, and spherical objects, such as marbles, which can be used to deconstruct said structures. Preferably, but not essentially, a ball retaining wall to at least partially encircle said structures may also be provided.

BACKGROUND OF INVENTION

Packs of playing cards, comprising 52–54 rectangular planar cards, usually about 90×120 mm in size, have traditionally been used, usually by children, in addition to their conventional and intended use for card games of varying degrees of intellectual skill, for manual skill games which generally require the participants to build three dimensional structures or "card houses", which may require some considerable skill and manual dexterity to construct, and which are extremely fragile and very easy to deconstruct, often only by misplacing a single card. The present invention is an extension of these known manual skill games, requiring the use of both planar and articulated cards so as to build somewhat less fragile structures, and marbles, or other spherical objects or balls, to deconstruct the structures.

OBJECT OF INVENTION

It is an object of the present invention to provide a kit for a game of skill in which a plurality of cards are used to erect deconstructable structures, and marbles or the like are used as projectiles to deconstruct the structures.

BRIEF DESCRIPTION OF INVENTION

By one aspect of this invention there is provided a kit for playing a construction and deconstruction game, comprising a plurality of planar card members, and a plurality of articulated, V-shaped card members from which a structure of any selected shape may be constructed, and a plurality of spherical objects adapted to be projected against said structure so as to effect deconstruction of at least a portion thereof.

DETAILED DESCRIPTION OF PREFERRED EMBODIMENT

Figure 1:
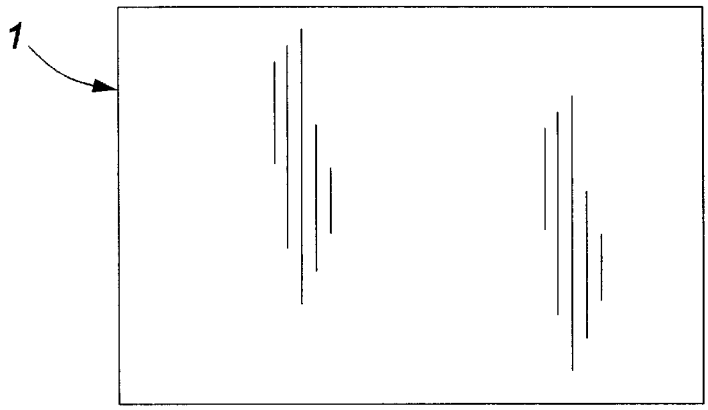
FIG. 1 is a perspective view of a planar card according to one embodiment of the present invention.
Figure 4:
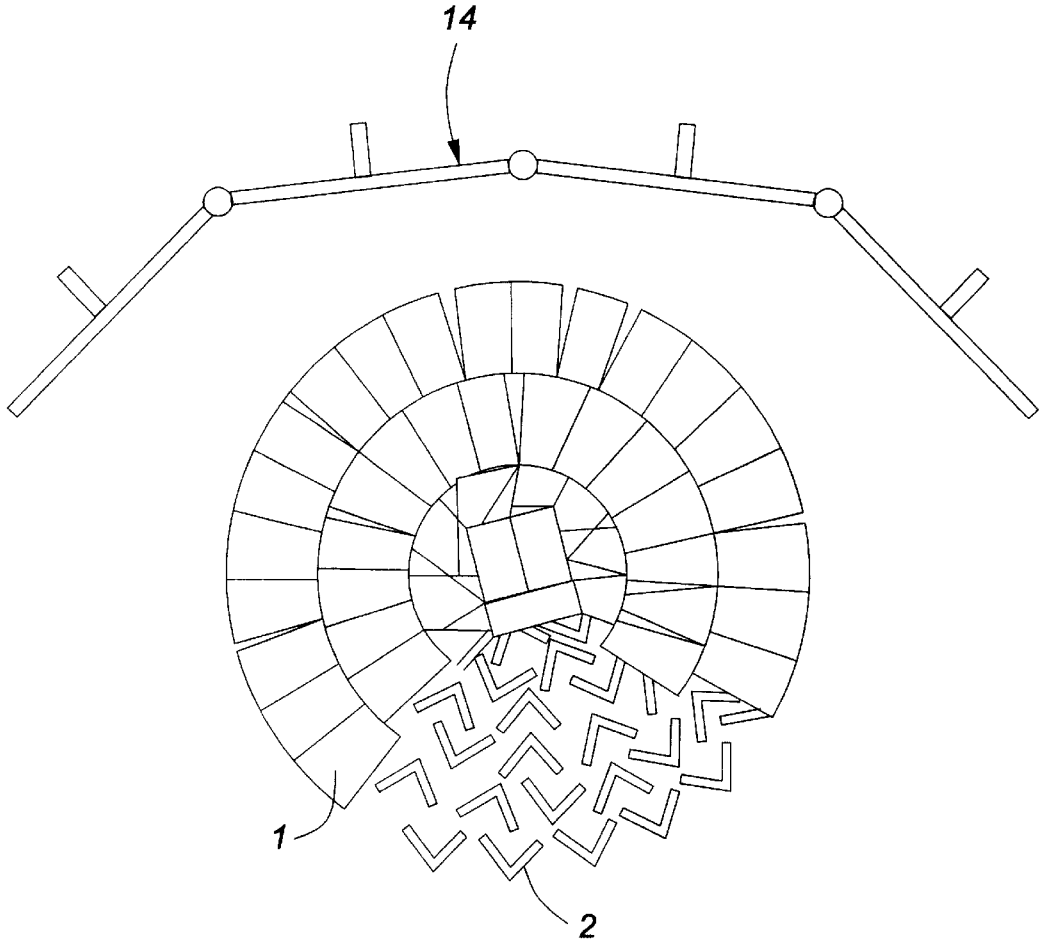
FIG. 4 is a plan view of a card structure erected using the cards of FIGS. 1,2 and 3.
Figure 5:
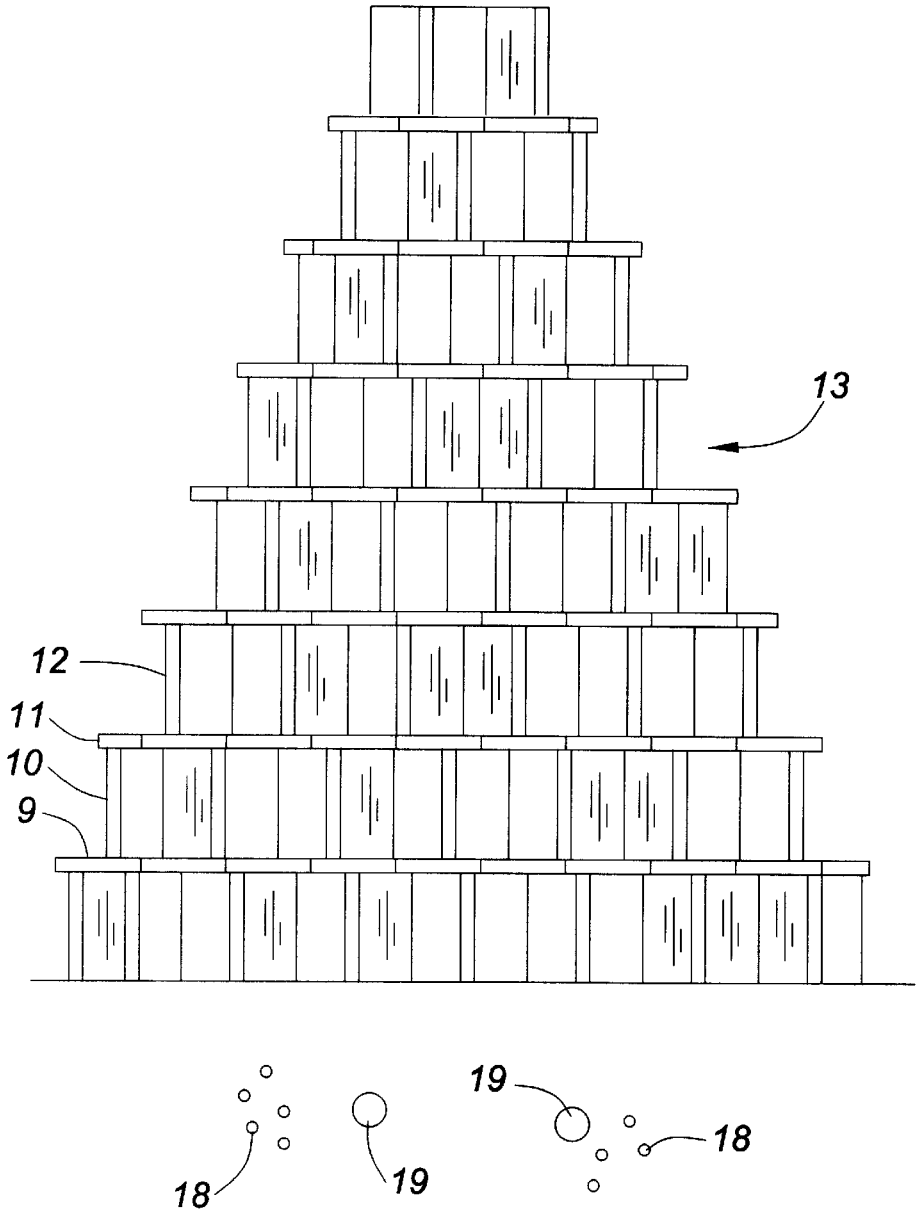
FIG. 5 is a side view of the structure of FIG. 4.

In order to erect a deconstructable structure, such as that shown in FIGS. 4 &5, a plurality of planar cards 1, as seen in FIG. 1 are required. The number of cards required is a matter of choice and may range upwardly from about 52 to over 600, depending upon the size of the structure required.

Figure 2:
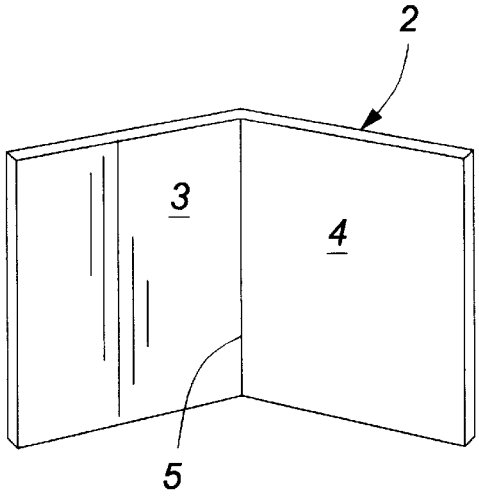
FIG. 2 is a perspective view of an articulated card according to another aspect of this invention.
Figure 3:
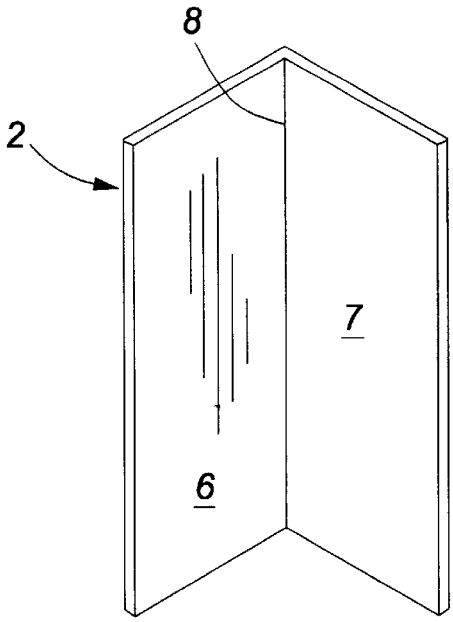
FIG. 3 is a perspective view of an alternate version of the articulated card of FIG. 2.

In addition, a plurality of v-shaped articulated biplanar cards 2, which are bent about a transverse axis 5 (FIG. 2) or a longitudinal axis 8 (FIG. 3) so as to provide substantially square faces 3,4, or rectangular faces 6,7, as seen in FIGS. 2 and 3 respectively, are provided. The size of cards 1,2 is essentially a matter of choice, but 6×9 cms playing cards are typical. The card stock is also a matter of choice, but should be thick enough to be substantially rigid or about 1 mm thick. FIGS. 1,2 and 3 show rectangular cards with sharp 90° corners but it will be appreciated that cards with rounded corners may also be employed.

In order to build a structure, a plurality of v-cards 2 are placed, on edge vertically or horizontally as desired, such as in a circle as seen in FIG. 4 and additional v-cards 2 are placed within that circle as also seen in FIG. 4. A plurality of planar cards 1 are then placed horizontally on the v-cards 2, as seen in FIGS. 4 &5, so as to substantially cover the entire area of the cards 2 and form a layer 9. A second layer 10 of v-cards 2 is then erected on layer 9 and followed by a layer 11 of horizontal planar cards 1, and then another layer 12 of v-cards 2, and so on until the supply of cards 1 &2 has been exhausted, thus forming the circular structure 13 as seen in FIG. 5. It will be appreciated that the exact shape of the structure 13 is a matter of choice and that shown in FIGS. 4 &5 is merely for illustrative purposes and is not limiting upon the shapes contemplated by the present invention.

Figure 6:
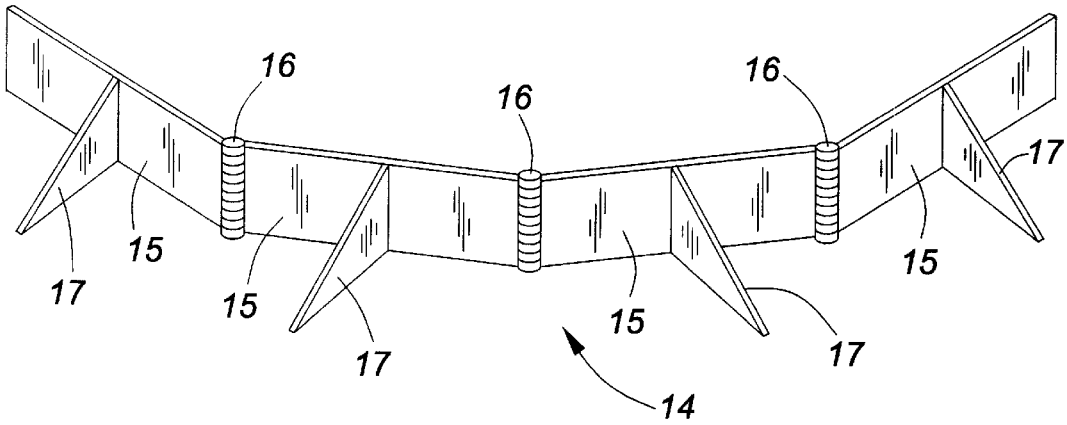
FIG. 6 is a rear perspective view of a ball retaining wall which may be used to at least partially enclose a structure according to FIG. 4.

Before deconstruction it is preferred, but not essential, to provide a ball retaining wall or fence 14 (FIGS. 4 &6) comprising a plurality of hingedly interconnected planar panels 15 provided with hinge pins 16, and a plurality of substantially triangular support members 17 (FIG. 6) at spaced intervals along the wall, partially around the structure 13, as seen in FIG. 4.

The second phase of the game may now commence by firing marbles, or other spherical objects 18 at any selected portion of the structure 13 with sufficient force so as to dislodge one or more of the cards 1,2 and cause all or part of the structure 13 to collapse. It will be appreciated that depending on the number of v-cards 2 employed in any particular layer, the structure will be more or less rigid and substantial force may be required to knock the structure down. Accordingly, in a preferred embodiment of the invention, marbles of different sizes may be employed or spheres, such as metal ball bearings and the like, which may be relatively heavy may be selected to facilitate the deconstruction. The method of firing the marble is a matter of choice and may be an underarm bowling action or merely flicking between finger and thumb in conventional manner.

I claim:

1. A kit for playing a construction and deconstruction game, comprising; a plurality of planar card members and a plurality of articulated, V-shaped card members from which a freestanding unstable structure may be constructed without reconfiguring shapes of the planar and V-shaped card members, and a plurality of untethered freely movable spherical projectiles adapted to be projected against a structure constructed of a plurality of the planar and V-shaped card members so as to effect deconstruction of at least a portion of the structure.

2. A kit as claimed in claim 1 wherein said spherical projectiles are selected from a group of projectiles consisting of glass marbles and steel balls.

3. A kit as claimed in claim 1 including a freestanding projectile retaining wall adapted to at least partially surround the structure constructed to thereby retain projectiles projected against the structure.

4. A kit as claimed in claim 3 wherein said wall includes a plurality of hingedly connected panels.

* * * * *